United States Patent [19]

Fletcher

[11] 4,027,388

[45] June 7, 1977

[54] SCRAPER

[75] Inventor: Arthur T. Fletcher, Bristol, Conn.

[73] Assignee: The Fletcher-Terry Company, Farmington, Conn.

[22] Filed: Oct. 14, 1975

[21] Appl. No.: 621,946

[52] U.S. Cl. ..... 30/171

[51] Int. Cl.[2] ..... A47L 13/08

[58] Field of Search ..... 15/104 S, 236 R; 30/169, 171, 446.5, 356

[56] References Cited

UNITED STATES PATENTS

| | | | |
|---|---|---|---|
| 1,434,914 | 11/1922 | Rhodes | 30/171 |
| 1,447,039 | 2/1923 | Rhodes | 30/171 |
| 1,768,537 | 7/1930 | Alexander | 30/171 |
| 2,116,282 | 5/1938 | Romeo | 30/171 |
| 2,259,662 | 10/1941 | Roberts | 30/171 |
| 2,306,083 | 12/1942 | Rioux | 30/171 |
| 2,312,809 | 3/1943 | Fletcher | 30/171 |
| 2,494,455 | 1/1950 | Soldani | 30/171 |

FOREIGN PATENTS OR APPLICATIONS

| | | | |
|---|---|---|---|
| 131,487 | 4/1951 | Sweden | 30/171 |

*Primary Examiner*—Daniel Blum
*Attorney, Agent, or Firm*—McCormick, Paulding & Huber

[57] ABSTRACT

A thin rectangular blade of flat configuration has its two longer edges rolled or burnished to form alternatively usable sharpened edges. The blade is held in a structure which includes a handle having a concave surface against which the blade is adapted to be clamped by a convex clamping member in order to bend the initially flat blade into an arcuate configuration such that the exposed scrapping edge is curved in order to reduce the likelihood that its edge portions will gouge a workpiece or the like. The blade is oriented at an angle with respect to the longitudinal axis of the handle, and the radius of curvature of the bent blade is approximately twice the length of its longer edges. A screw fastener holds the clamping member to the handle and clearance is provided for the reserve, or unused scraper edge of the blade when the blade is so clamped. In one version the screw fastener is threadably received in the handle and in another version, a wingnut is utilized on the screw fastener to achieve the clamping action.

1 Claim, 6 Drawing Figures

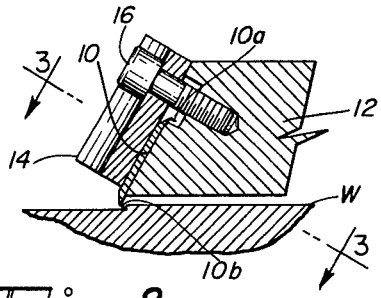
Fig. 2
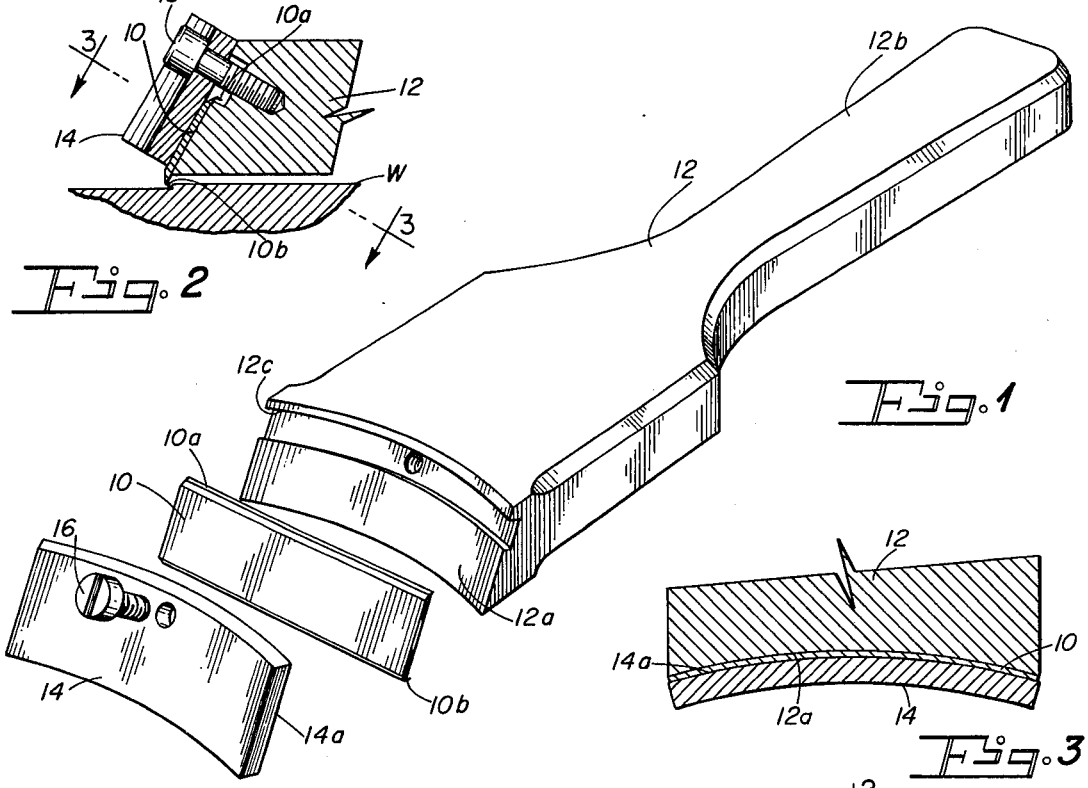
Fig. 1
Fig. 3
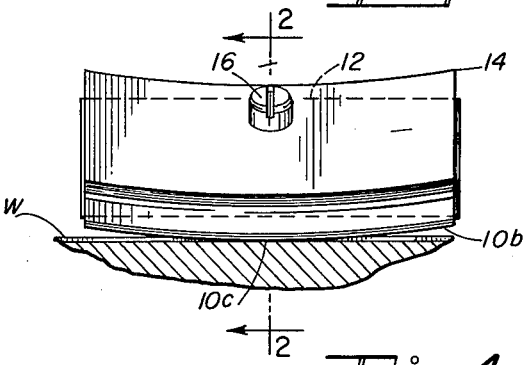
Fig. 4
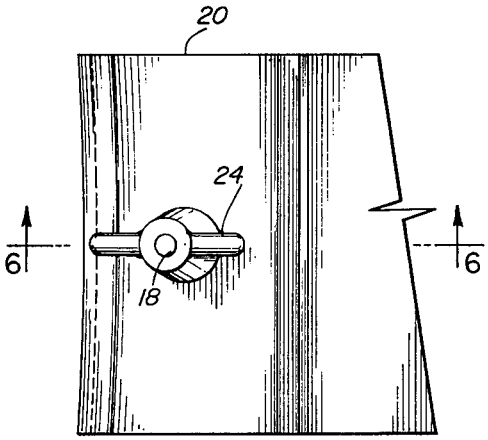
Fig. 5
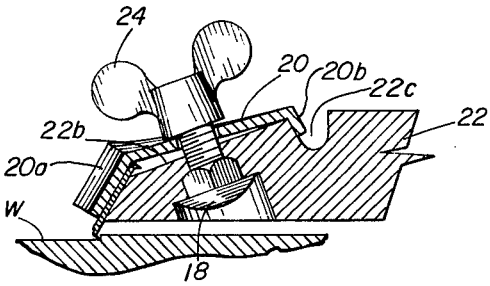
Fig. 6

SCRAPER

SUMMARY OF THE INVENTION

This invention relates generally to scrapers of the hand-held variety, and deals more particularly with a scraper adapted to hold a generally flat scraper blade so that one of two parallel edges of the blade can be positioned for use.

In accordance with the present invention, means is provided for retaining the resilient blade in an arcute stressed configuration with the result that the normally rectilinear scraping edge takes on an arcuate configuration so as to reduce the likelihood of gouging of the surface to be scrapped, and also to reduce the magnitude of the applied force necessary in using the scraper.

In its presently preferred form the scraper has an elongated handle which defines a generally concave blade receiving surface, which surface is inclined with respect to the axis of the handle. The blade is adapted to be clamped between said concave surface and the convex surface of a clamping member releasably secured to the end of the handle.

BRIEF DESCRIPTION OF THE DRAWINGS

FIG. 1 is an exploded perspective view of a scraper.

FIG. 2 is a generally vertical sectional view taken through the screw fastener used to hold the parts depicted in FIG. 1 in their assembled configuration being taken generally on line 2—2 of FIG. 4.

FIG. 3 is a horizontal sectional view through the mating parts depicted in FIG. 1 being taken generally on the line 3—3 of FIG. 2.

FIG. 4 is an end view of the assembled scraper with the arcuate scraping edge being shown in the process of scraping a workpiece or the like.

FIG. 5 is a plan view of an a preferred version of a scraper constructed in accordance with the present invention.

FIG. 6 is a vertical sectional view taken generallyon the line 6—6 of FIG. 5.

DETAILED DESCRIPTION

Turning now to the drawings in greater detail, FIG. 1 shows a generally flat rectangular blade 10 having opposed parallel edges 10*a* and 10*b* along the longer sides of the rectangle, which edges are sharpened and preferably rolled or burnished, so as to provide scraping edges of offset configuration, as best shown in FIG. 2.

Thus the blade 10 is flat, except for the offset provided at the sharpened and rolled or burnished scraper edges, 10*a* and 10*b*. Means is provided for bending the blade so that the blade assumes an arcuate configuration as shown in FIG. 3, with the result that the scraping edges 10*a* and 10*b* are rendered generally arcuate in configuration as best shown in FIG. 4. As there shown an intermediate segment 10*c* of the exposed scraper edge 10*b* is adapted to contact a generally flat workpiece W in order to provide a very efficient scraper such that the lower corners of the scraper blade do not gouge or otherwise deface the workpiece W to be scraped.

Turning now to a more detailed description of the means for retaining the blade in its arcuate, stressed configuration, said means including the handle 12, which handle has a concave blade receiving receptable 12*a* adjacent one end, and a formed handle portion at the opposite end 12*b*, which is adapted to be held by the user. Means is provided for clamping the initially flat blade in the concave receptacle 12*a*, and preferably said means includes a clamping member 14, which member has a blade engaging surface of convex configuration 14*a* adapted to contact the blade 10 and to clamp said blade between said surface 14*a* and said receptacle 12*a*. The screw 16 provides the necessary clamping force to hold these parts together.

It is an important feature of the present invention that the receptacle 12*a*, as well as the cooperating convex surface 14*a* of the clamping member, have a radius of curvature which is approximately twice the length of the longer scraperside edges 10*a* and 10*b* of the blade 10. This geometry, when taken together with the inclined configuration for the blade 10 with respect to the longitudinal axis of the handle 12, provides for the desired degree of curvature of the scraping edge 10*b*. In the process of scraping the exposed surface of a generally flat workpiece W, as shown in FIG. 2, the handle is preferably held parallel to the surface being scraped, and the blade 10 is oriented at an angle of less than 90°to the workpiece surface, but more than 45°with respect thereto.

While a screw fastener 16 is shown as being the preferred means for clamping the generally flat blade 10 between the convex and concave surfaces, 14*a* and 12*a* respectively, it will be apparent that other means might also be utilized, and in fact, FIG. 6 shows an alternative embodiment wherein a screw fastener 18 extends through aligned openings in the clamping member 20 and the handle 22, and rather than being threadably received in the handle 22 the screw fastener 18 carries a wingnut 24, permitting the user to conveniently achieve the desired force necessary to clamp the initially flat blade into its arcuate configuration. The handle 22 of the FIG. 6 version is of slightly different configuration adjacent the blade receiving receptacle end portion thereof, and the relieved surface 22*b* of the handle 22 is adapted to accommodate the stored or unused scraper edge 10*a* in much the same manner as the relieved portion 12*c* of the handle 12 shown in FIG. 1.

However, the FIG. 6 version does not have a clamping member 20 of different configurations than that shown in FIG. 1, said clamping member 20 of FIG. 6 comprising a generally U-shaped member having a forward leg 20*a* which defines the convex contour for engaging the blade 10 and having a rear leg 20*b* adapted to engage one side of a groove 22*c* defined for this purpose in the handle 22. These legs 20*a* and 20*b* are so arranged that a wedging action is exerted on the blade 10 as the clamping thumb screw, or wingnut 24, is rotated on the screw 18. The web portion of the U-shaped clamping member 20 comprises an upper marginal portion similar to that of the clamping member 14 of FIG. 1 in that it serves to cover the recess or relieved area of the handle which accommodates the stored or unused scraping edge 10*a* described previously. The forward leg 20*a* of the U-shaped clamping member 20 is preferably so inclined with respect to the longitudinal axis of the handle 22 such that the blade 10 is oriented at the acute angle in the desired range mentioned previously.

As a result of this angular orientation for the blade 10, when coupled with the arcuate contour of the stressed blade after it is clamped in the handle 12, the corners of the blade will contact the surface being scraped and only the intermediate segment, or curved center portion of the blade which leads the trailing corners of the blade, actually engages the surface to be scraped in a progressive contacting action such that the force required in the scraping process is minimized. Thus, the blade is so held in the handle that the center portion is lower than the two corners avoiding gouging of wood surface or the like and reducing the force necessary to achieve the scraping action.

I claim:

1. A scraper comprising a generally rectangular flat blade having at last two sharpened and rolled or burnished scraping edges defined along the opposed rectilinear longer sides, means for retaining said blade in an arcuate stressed configuration with one of said edges exposed and having an intermediate segment adapted to contact a flat surface to be scraped before the blades end portions, said blade retaining means including an elongated handle with a concave blade receiving receptacle at one end said receptacle having a relieved portion to accommodate the edge opposite said exposed edge, a clamping member of generally U-shaped configuration and defining a convex surface defined on the inner face of one leg of the U for engaging said blade, and an upper marginal portion defined by the web of the U, and the other leg of the U received in a locating groove defined in the handle, and a screw fastener extending through aligned openings in said clamping member and said handle to clamp said blade in said arcuate configuration, said blade being oriented at an obtuse angle with respect to the handle axis.

* * * * *